US008402804B2

(12) United States Patent
Nakao et al.

(10) Patent No.: US 8,402,804 B2
(45) Date of Patent: Mar. 26, 2013

(54) METHOD AND APPARATUS OF FORMING TAILORED BLANK PLATE

(75) Inventors: Keiichiro Nakao, Tochigi (JP); Takanori Sato, Tochigi (JP); Takuo Kobayashi, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 58 days.

(21) Appl. No.: 12/841,650

(22) Filed: Jul. 22, 2010

(65) Prior Publication Data

US 2011/0016945 A1 Jan. 27, 2011

(30) Foreign Application Priority Data

Jul. 23, 2009 (JP) ..... 2009-171789

(51) Int. Cl.
*B21D 22/00* (2006.01)
*B21D 22/21* (2006.01)

(52) U.S. Cl. ..... 72/347; 72/351; 72/465.1; 72/466.9; 72/482.91

(58) Field of Classification Search ..... 72/347, 72/348, 357, 358, 351, 465.1, 466.9, 482.91
See application file for complete search history.

(56) References Cited

U.S. PATENT DOCUMENTS

| | | | | |
|---|---|---|---|---|
| 5,016,458 | A * | 5/1991 | De Smet | 72/57 |
| 5,339,667 | A * | 8/1994 | Shah et al. | 72/58 |
| 5,557,961 | A * | 9/1996 | Ni et al. | 72/61 |
| 5,600,991 | A | 2/1997 | Munzen | |
| 6,089,072 | A * | 7/2000 | Fields | 72/379.4 |
| 6,185,977 | B1 * | 2/2001 | Schiessl et al. | 72/342.1 |
| 7,121,128 | B2 * | 10/2006 | Kato et al. | 72/68 |
| 7,171,838 | B2 * | 2/2007 | Shiokawa | 72/356 |
| 7,275,781 | B2 * | 10/2007 | Wakefield | 296/102 |
| 7,320,239 | B1 | 1/2008 | Kruger et al. | |
| 7,490,503 | B1 * | 2/2009 | Kanemitsu et al. | 72/379.2 |
| 7,624,611 | B2 * | 12/2009 | Saitou | 72/349 |
| 7,669,450 | B2 * | 3/2010 | Friedman et al. | 72/60 |
| 7,716,809 | B2 * | 5/2010 | Miura et al. | 29/596 |
| 7,941,907 | B2 * | 5/2011 | Yang et al. | 29/419.2 |
| 8,061,174 | B2 * | 11/2011 | Szuba et al. | 72/267 |
| 2003/0056563 | A1 * | 3/2003 | McClung | 72/348 |
| 2004/0250594 | A1 * | 12/2004 | Schwenk | 72/348 |
| 2006/0236741 | A1 * | 10/2006 | Saitou | 72/348 |

FOREIGN PATENT DOCUMENTS

| | | | |
|---|---|---|---|
| DE | 4104256 | A1 * | 8/1992 |
| EP | 0726105 | B1 | 7/2003 |

(Continued)

*Primary Examiner* — Bena Miller
(74) *Attorney, Agent, or Firm* — Rankin, Hill & Clark LLP

(57) ABSTRACT

A device for forming a tailored blank plate 12 having a thick plate 14 connected to a thin plate 16 to a desired configuration is provided with a press device 10 and a re-strike device 100. The press device 10 is provided with a first punch part 18, a first die part 20 and holder parts 22 and 22. Between the first punch part 18 and the first die part 20, the tailored blank plate 12 is mounted and positioned so that a stepped part 12*b* intersects orthogonally to punch protruding parts 50*a* and 50*b* of the first punch part 18 and punch recessed parts 72*a* and 72*b* of the first die part 20 to press-form the tailored blank plate 12. Then, the press-formed tailored blank plate 212 is moved to the re-strike device 100 to carry out a re-striking process by a second punch part 102 and a second die part 104, so as obtain the tailored blank plate 300 of a final shape.

5 Claims, 11 Drawing Sheets

FOREIGN PATENT DOCUMENTS

| | | |
|---|---|---|
| JP | 9001254 | 1/1997 |
| JP | 2003-290842 | 10/2003 |
| JP | 2004034053 | 2/2004 |
| JP | 2009050863 | 3/2009 |

* cited by examiner

METHOD AND APPARATUS OF FORMING TAILORED BLANK PLATE

BACKGROUND OF THE INVENTION

1. Field of the Invention

The present invention relates to a method and an apparatus of forming a tailored blank plate obtained by connecting steel plates having thickness and materials which are different from each other.

2. Related Art

Usually, a workpiece 2 shown in FIG. 13A is processed insteps in which the workpiece is drawn to have a depth shallower than that of a desired final configuration by a pressing device (see FIG. 13B), and then the workpiece is deeply re-struck as a finish stamping (see FIG. 13C) to have the desired final configuration. In this case, a surface of a stepped part of the workpiece shown by a reference numeral 2*a* in FIG. 13C is not re-struck. However, for instance, if the surface is used for an external appearance surface of a motor vehicle, a high quality in a draw forming process is especially requested.

Further, when a tailored blank material obtained by connecting a thin plate integrally to a thick plate is formed as the workpiece, a press-forming process is carried out by using a metal mold including a stepped part for absorbing a thickness difference between the thin plate and the thick plate at a position corresponding to a part near the connecting part of the thin plate and the thick plate. However, the position of the stepped part between the thin plate and the thick plate of the tailored blank material may be occasionally displaced from the position of the stepped part formed in the metal mold due to a displacement of an initial position between the tailored blank material and the metal mold or the flow of the blank material during a draw forming process so that a gap may be formed between the thin plate and the metal mold. As a result, a dent (recess) may be occasionally formed in the tailored blank material.

The above-described dent is supposed to be formed in such a way that a holder not shown in the drawing is moved in the direction shown by an arrow mark F during a forming process as shown in FIG. 14 and the tailored blank material 2 is relatively pulled to exert a force shown by an arrow mark G on a part at which the tailored blank material 2 comes into contact with a punch 4 when the tailored blank material 2 comes into contact with the punch 4 formed as a male mold, so that the gap arises between a plate forming the tailored blank material 2 and the punch 4 in the vicinity of the stepped part of the metal mold.

The occurrence of the dent deteriorates the quality and external appearance of a product and a post-process such as a re-striking process for smoothing the dent is necessary so that workability in production processes is deteriorated. When the dent is formed, even if the post-process of the tailored blank material for smoothing the dent is carried out, an inconvenience arises that corrugations or folds are formed in the tailored blank material.

Thus, for instance, JP-A-2003-290842 proposes a method in which an inclined stepped part is provided in a metal mold correspondingly to a stepped part of a tailored blank material to avoid the occurrence of the dent in the vicinity of a connecting surface of a thin plate and a thick plate forming the tailored blank material under the pressure during a draw forming process. According to this method, a slightly protruding mountain shaped part is formed in the vicinity of the connecting surface, however, the mountain shaped part is smoothed in a re-striking process to obtain a final configuration of the tailored blank material. Namely, in the method of JP-A-2003-290842, after the tailored blank material is drawn to have a shallow depth, the tailored blank material is deeply re-struck to obtain a desired product.

In the method of JP-A-2003-290842, the displacement of the tailored blank plate during a forming process must be taken into consideration. Specifically, the displacement of a position of the stepped part of the thin plate and the thick plate forming the tailored blank plate must be considered to set an initial position of the tailored blank plate. However, it is inconveniently difficult to precisely predict a quantity of displacement of the position and assuredly suppress the occurrence of the dent (refer it also to as a deformation, hereinafter). Then, as a result, a problem arises the tailored blank plate having a desired final configuration is hardly obtained, especially, the tailored blank plate whose external appearance form is beautiful is hardly obtained.

SUMMARY OF THE INVENTION

One or more embodiments of the invention provide a method and an apparatus of forming a tailored blank plate that can avoid an occurrence of a deformation without giving an influence to a workability even when a position of a stepped part of a thin plate and a thick plate of the tailored blank plate is displaced from a position of a stepped part formed in a metal mold due to a gap formed by a displacement at an initial position of the tailored blank plate or the metal mold or a flow of the tailored blank plate during a draw forming process.

In accordance with one or more embodiments of the invention, a method of forming a tailored blank plate (12) having a stepped part (12*b*) in which a thin plate (16) is integrally connected to a thick plate (14) is provided with the steps of: positioning the tailored blank plate (12) by mounting a side of the stepped part (12*b*) of the tailored blank plate (12) on a first punch protruding part (50*a*, 50*b*) swollen on a first punch part (18); pressing a plate part (12*a*) of the tailored blank plate (12) including a connecting surface (12*c*) of the thin plate (16) and the thick plate (14), by making a first die part (20) in contact with the positioned tailored blank plate (12), displacing the first die part (20) with respect to the first punch protruding part (50*a*, 50*b*), and pressing a pressing part (70) of the first die part (20) to the plane part (12*a*); press-forming the tailored blank plate (12) by moving first punch part (18) and the first die part (20) to relatively come close to each other while fixing the stepped part (12*b*) of the tailored blank plate (12) between the first punch protruding part (50*a*, 50*b*) of the first punch part (18) and a first punch recessed part (72*a*, 72*b*) of the first die part (20); and re-striking the press-formed tailored blank plate (212).

According to this method, the tailored blank plate is mounted and positioned on the first punch protruding part, and then, the first die part is allowed to abut on the positioned tailored blank plate. As a result, since the tailored blank plate is especially expanded and extended while being regulated by the first punch protruding part, corrugated forms or squeezed forms do not appear on the surface thereof. Accordingly, a surface of the tailored blank plate is effectively smoothly finished. Further, since the stepped part of the tailored blank plate is fixed between the first punch protruding part and the first punch recessed part, the surface of the tailored blank plate is not deformed as described above. Therefore, the configuration of an external appearance of the tailored blank plate is advantageously beautifully finished.

In the step of positioning the tailored blank plate (12), the tailored blank plate (12) may be mounted on the first punch protruding part (50*a*, 50*b*) so that an extending direction of the stepped part (12*b*) of the tailored blank plate (12) intersects an extending direction of the first punch protruding part (50*a*, 50*b*).

According to this method, when the tailored blank plate is positioned on the upper surface of the first punch protruding part, the tailored blank plate is mounted on the first punch protruding part so that the extending direction of the stepped part of the tailored blank plate intersects, preferably intersects orthogonally to the extending direction of the first punch protruding part. Accordingly, when the tailored blank plate is sandwiched and processed between the first punch part and the first die part, the tailored blank plate is hardly displaced. Consequently, the stepped part of the tailored blank plate can be adequately positioned by the first punch protruding part, so that the surface of the tailored blank plate can be avoided form being deformed.

Moreover, the step of re-striking may include: mounting the press-formed tailored blank plate (212) on a second punch part (102) for re-striking so that the tailored blank plate (212) is bridged over at least one set of second punch protruding parts (112*a*, 112*b*) formed in the second punch part (102); and displacing a second die part (104) for re-striking toward a part (218) between the second punch protruding parts (112*a*, 112*b*) and pressing the part (218) between the second punch protruding parts (112*a*, 112*b*) by a pad (130), so as to re-strike the tailored blank plate (212) by the second punch part (102) and the second die part (104).

According to this method, in the re-striking process after the press-forming process is finished, the pad in the second die part is allowed to abut on the tailored blank plate between the one set of second punch protruding parts to fix the tailored blank plate, and then, the surface of the tailored blank plate exposed to an external part is pressed by the pad. Thus, the re-striking process is more smoothly carried out to make the surface beautiful without generating a deformation.

In addition, in accordance with one or more embodiments of the invention, an apparatus of forming a tailored blank plate (12) having a stepped part (12*b*) in which a thin plate (16) is integrally connected to a thick plate (14) is provided with: a press device (10); and a re-strike device (100). The press device (10) is provided with: a first punch part (18) having a thin plate punch part (30) on which the thin plate (16) is mounted, a thick plate punch part (28) on which the thick plate (14) is mounted, and a first punch protruding part (50*a*, 50*b*) swollen and extending so as to intersect an extending direction of a stepped part (40) formed between the thin plate punch part (30) and the thick plate punch part (28); a first die part (20) having a first punch recessed part (72*a*, 72*b*) formed to correspond to the first punch protruding part (50*a*, 50*b*); and a holder part (22) for holding the tailored blank plate (12) between the first die part (20) and the holder part (22). The re-strike device (100) is provided with: a second punch part (102) on which the tailored blank plate (212) that is press-formed by the press device (10) is mounted and positioned; and a second die part (104) configured to re-strike said press-formed tailored blank plate (212) between the second punch part (102) and the second die part (104). The second die part (104) includes a pad (130). The pad (130) and a punch main body (108) of the second punch part (102) press the tailored blank plate (212) during a re-striking of the tailored blank plate (21).

According to this structure, the apparatus includes the press device and the re-strike device. Since the press device includes the first punch part having the first punch protruding part extending so as to intersect the extending direction of the stepped part of the tailored blank plate, when the tailored blank plate is mounted on the first punch protruding part to press the tailored blank plate by the first die part, the tailored blank plate including the stepped part is not displaced. Accordingly, the tailored blank plate whose surface has a beautiful external appearance can be obtained. Further, when the press-formed tailored blank plate is re-struck, since the re-strike device has the pad in the second die part so that the press-formed tailored blank plate may be pressed and fixed, the tailored blank plate can be more accurately processed and a product whose configuration of an external appearance is excellent can be obtained.

Further, in the above structure, the first punch protruding part (50*a*, 50*b*) swollen in the first punch part (18) may extend to be perpendicular to the stepped part (40) from a flat surface (34) for the thick plate to a flat surface (38) for the thin plate formed on a top surface of a punch main body (26) of the first punch part (18).

According to this structure, since the stepped part intersects orthogonally to the first punch protruding part from the flat surface for the thick plate to the flat surface for the thin plate formed on the top surface of the punch main body, the displacement of the tailored blank plate mounted on the first punch protruding part during a process can be more effectively avoided.

Further, in the above structure, the first punch protruding part (50*a*, 50*b*) of the first punch part (18) may extend over an entire length from the flat surface (34) for the thick plate to the flat surface (38) for the thin plate, and the first punch recessed part (72*a*, 72*b*) of the first die part (20) may have a length corresponding to a length of the first punch protruding part (50*a*, 50*b*).

According to this structure, since the first punch protruding part is provided over the entire length from the flat surface for the thick plate to the flat surface for the thin plate forming the punch main body, an inexpensive and efficient metal mold can be obtained during the manufacture of the first punch part itself or during the manufacture of the punch recessed part of the first die part.

According to the forming method and apparatus of forming the tailored blank plate of the embodiments, the displacement does not occur during a forming. Accordingly, the tailored blank plate does not flow during the process nor corrugations or squeezes are formed on a surface. As a result, the tailored blank plate that is beautiful in its surface and excellent in its quality can be obtained.

Other aspects and advantages of the invention will be apparent from the following description and the appended claims.

DETAILED DESCRIPTION OF THE EXEMPLARY EMBODIMENTS

A forming method of a tailored blank plate according to an exemplary embodiment of the present invention will be described below in detail, by referring to the attached drawings, in relation to an apparatus for embodying the forming method of the tailored blank plate.

The apparatus of forming a tailored blank plate according to the exemplary embodiment basically includes a press device and a re-strike device.

Initially, a tailored blank plate 12 processed by the press device 10 will be described.

Figure 1:
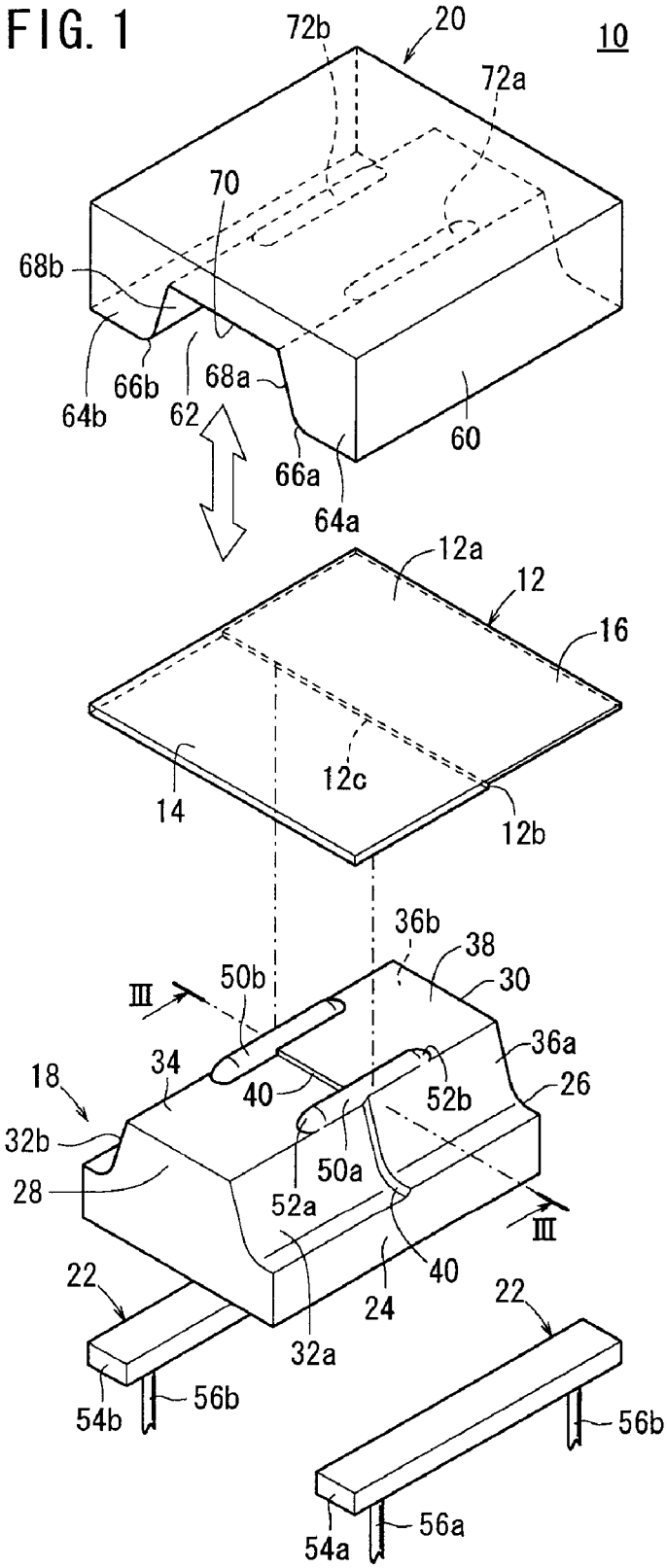
FIG. 1 is an exploded perspective view showing a press device according to an exemplary embodiment.

As can be understood from FIG. 1, the tailored blank plate 12 is made of a metal plate formed by connecting a thick plate 14 integrally to a thin plate 16 by a welding process. One surface (an upper surface in FIG. 1) is a flat surface 12*a* and the other surface (a lower surface in FIG. 1) has a stepped part 12*b* formed by a difference in thickness between the thick plate 14 and the thin plate 16. In this case, a surface in which the thick plate 14 is connected to the thin plate 16 is designated as a connecting surface 12*c*.

Now, the press device 10 is described below. As shown in FIG. 1, the press device 10 includes a first punch part 18 formed with a male metal mold, a first die part 20 formed with a female metal mold and a pair of holder parts 22 and 22 that are arranged at both sides of the first punch part 18 to position and hold the tailored blank plate 12 in cooperation with the first die part 20. The first punch part 18 includes a first rectangular base part 24 and a first punch main body 26 formed integrally with the first base part 24 and standing upward in FIG. 1. The first punch main body 26 includes a thick plate punch part 28 and a thin plate punch part 30. The thick punch part 28 includes, at both side surfaces thereof, curved and tapered surfaces 32*a* and 32*b* when the thick plate punch part 28 rises from the first base part 24 and a flat surface 34 for the thick plate at a part where the tapered surfaces 32*a* and 32*b* terminate. Similarly, the thin plate punch part 30 standing upward from the first base part 24 includes, at both sides thereof, curved and tapered surfaces 36*a* and 36*b* and a flat surface 38 for the thin plate at a part where the tapered surfaces 36*a* and 36*b* terminate. In a boundary part of the thick punch part 28 and the thin punch part 30, a stepped part 40 is formed that corresponds to the stepped part of the thick plate 14 and the thin plate 16 of the tailored blank plate 12. The stepped part 40 is extended to the first base part 24 between the tapered surface 32*a* and the tapered surface 36*a*, and between the tapered surface 32*b* and the tapered surface 36*b*.

Punch protruding parts 50*a* and 50*b* are formed from the flat surface 34 for the thick plate to the flat surface 38 for the thin plate so as to stride over the stepped part 40 between the thick plate punch part 28 and the thin pate punch part 30. The punch protruding parts 50*a* and 50*b* have deformed projectile shaped curved surfaces 52*a* and 52*b* respectively formed at both ends.

At both side parts of the first base part 24 of the first punch part 18 as a fixed metal mold, the holder parts 22 and 22 are provided that have the same length as the longitudinal length of the first base part 24. Namely, the holder parts 22 have rectangular parallelepiped holder main body parts 54*a* and 54*b*. The holder main body parts 54*a* and 54*b* are held so as to freely move upward and downward by cylinder rods 56*a* and 56*b* extending from cylinders not shown in the drawing.

Now, the first die part 20 will be described below. The first die part 20 has a thick main body 60 and a recessed part 62 formed in a lower part thereof that is expanded at an angle corresponding to the tapered surfaces 32*a* and 32*b* and the tapered surfaces 36*a* and 36*b* of the first punch part 18. In the main body 60, leg parts 64*a* and 64*b* are formed due to the presence of the recessed part 62. In side end parts of the recessed part 62 in the leg parts 64*a* and 64*b*, gentle curved parts 66*a* and 66*b* are formed. The curved parts 66*a* and 66*b* are connected to side wall parts 68*a* and 68*b* forming the recessed part 62. The other end parts of the side wall parts 68*a* and 68*b* are connected to a flat pressing part 70 as a top surface of the recessed part 62. At both side pert in a central part of the pressing part 70, punch recessed parts 72*a* and 72*b* are formed that correspond to the punch protruding parts 50*a* and 50*b*.

In the present exemplary embodiment, the re-strike device 100 is used (see FIG. 2) in addition to the press device 10. The re-strike device 100 includes a second punch part 102 and a second die part 104. The second punch part 102 includes a rectangular second base part 106 and a second punch main body 108 standing upward from the second base part 106 in FIG. 2. The second base part 106 and the second punch main body 108 are integrally formed. The second punch main body 108 standing from the second base part 106 has tapered surfaces 110*a* and 110*b* on both side surfaces thereof. At parts where the tapered surfaces 110*a* and 110*b* terminate, horizontally extending stepped parts 112*a* and 112*b* are formed. Tapered surfaces 114*a* and 114*b* stand from the stepped parts 112*a* and 112*b*. A part in which the tapered surfaces 114*a* and 114*b* terminate is formed as a flat surface 116.

A rectangular parallelepiped shaped second die part 104 is provided with a female type recessed part 120 corresponding to the tapered surfaces 110*a* and 110*b*, the stepped parts 112*a* and 112*b* and the tapered surfaces 114*a* and 114*b* of the second punch part 102. A top part at which the recessed part 120 terminates is formed as a chamber 132 for accommodating a pad 130.

To the top part forming the chamber 132, elastic bodies, preferably, one end parts of coil springs 134*a* and 134*b* are engaged and attached. The other end parts of the coil springs 134*a* and 134*b* are connected to the pad 130. Accordingly, the pad 130 is constantly urged from an inner part of the chamber 132 to the recessed part 120 by the resilient force thereof.

The forming device of the tailored blank plate according to the present exemplary embodiment is basically constructed as described above. Now, the forming method of the tailored blank plate will be described below in relation to an operation of the forming device of the tailored blank plate to be used.

Initially, the holder parts 22 and 22 are lifted from both the sides of the first base part 24 forming the fixed first punch part 18 to mount the tailored blank plate 12 on the holder main body parts 54*a* and 54*b* of the holder parts 22 and 22. In this case, the extending direction of the connecting surface 12*c* of the tailored blank plate 12 is positioned to a direction intersecting the extending directions of the punch protruding parts 50*a* and 50*b* of the first punch part 18, for instance, a direction intersecting orthogonally to the extending directions of the punch protruding parts.

Then, the first die part 20 is lowered under an urging operation of a driving source not shown in the drawing to allow the bottom surfaces of the leg parts 64*a* and 64*b* to abut on the flat surface 12*a* of the tailored blank plate 12 as a workpiece and sandwich the tailored blank plate 12 between the holder parts 22 and 22 and the first die part 20. This state is shown in FIG. 3.

Figure 3:
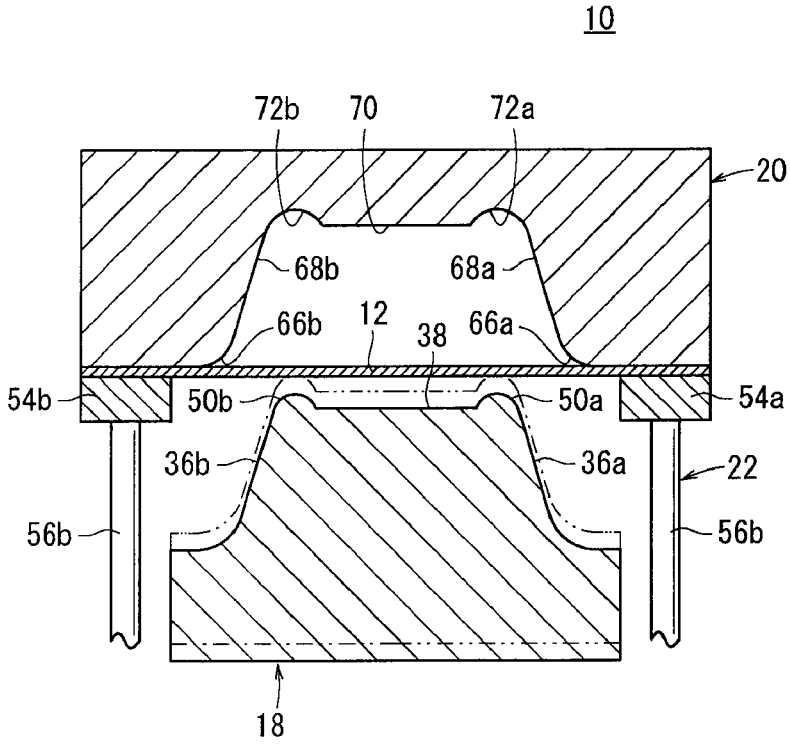
FIG. 3 is an entire sectional view showing an initial position of the press device according to the exemplary embodiment in a section taken along a line in FIG. 1.

Then, when the holder parts 22 and 22 are integrally lowered together with the first die part 20, upper curved surfaces of the punch protruding parts 50*a* and 50*b* forming the first punch part 18 intersect orthogonally to the lower surface of the stepped part 12*b* of the tailored blank plate 12 and abut thereon (see a broken line in FIG. 3).

Figure 4:
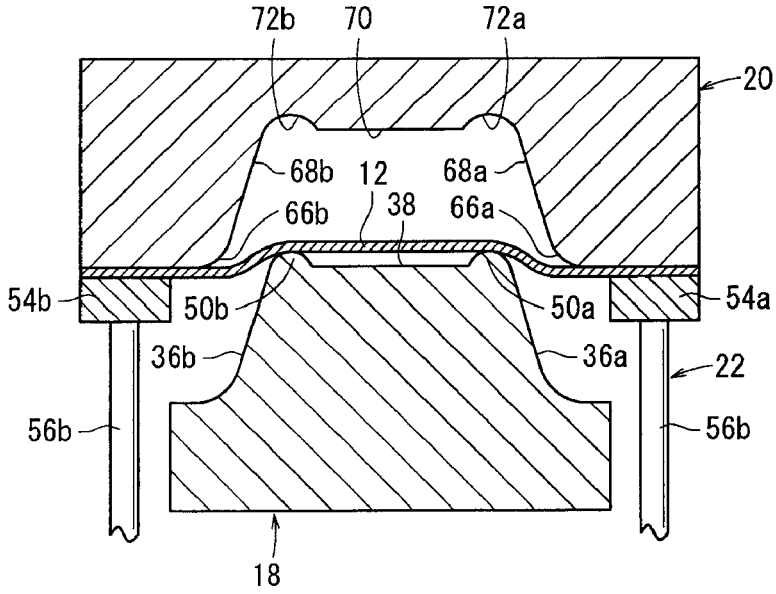
FIG. 4 is an entire sectional view taken along the line in FIG. 1 showing a state that a tailored blank plate is positioned by first punch protruding parts.

Further, when the holder parts 22 and 22 are lowered integrally with the first die part 20 in the drawing, the tailored blank plate 12 has its central part curved upward under an operation that the tailored blank plate 12 is sandwiched between the punch protruding parts 50*a* and 50*b*, the holder main body parts 54*a* and 54*b* of the holder parts 22 and 22 and the leg parts 64*a* and 64*b* of the first die part 20 (see FIG. 4).

Figure 5:
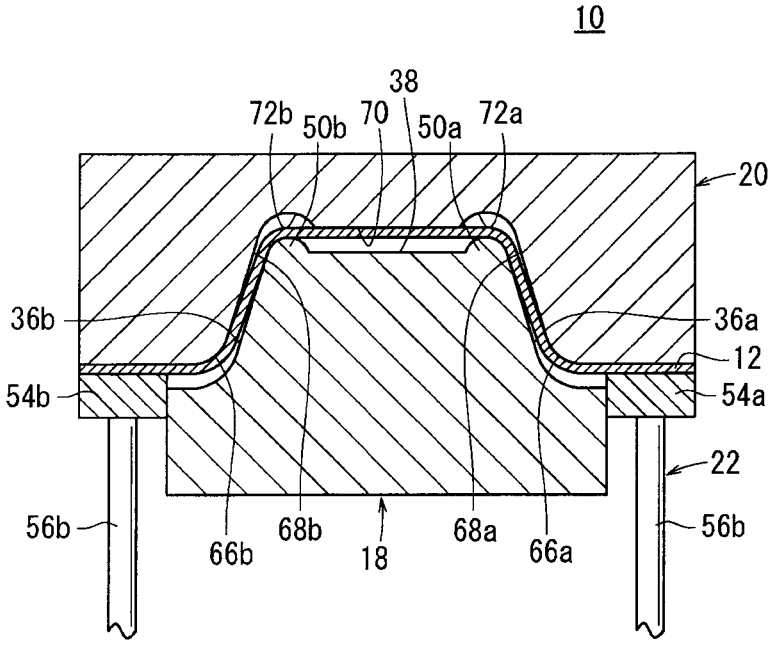
FIG. 5 is an entire sectional view taken along the line in FIG. 1 showing a state immediately before the tailored blank plate is processed by the first punch protruding parts and first punch recessed parts.

Further, when the holder parts 22 and 22 and the first die part 20 are lowered, both sides of the central part of the tailored blank plate 12 are curved in the configuration of a skirt in section under the cooperation of the tapered surfaces 32*a*, 32*b*, 36*a* and 36*b* of the first punch part 18 and the side wall parts 68*a* and 68*b* of the first die part 20 (see FIG. 5). As apparent from FIG. 5, the pressing part 70 of the first die part 20 abuts on the flat surface 12*a* of the tailored blank plate 12 bridged over the punch protruding parts 50*a* and 50*b*.

Figure 6:
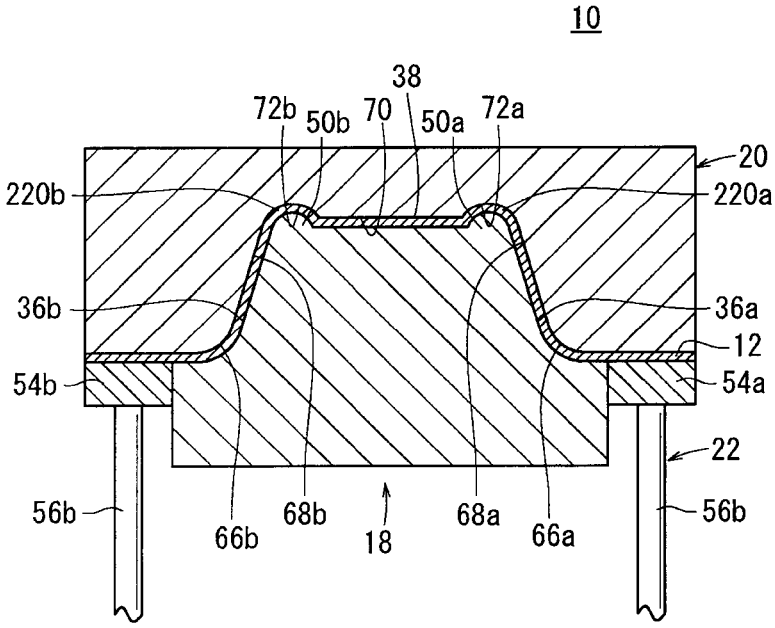
FIG. 6 is an entire sectional view taken along the line in FIG. 1 showing a state the tailored blank plate is press-formed by the first punch protruding parts and the first punch recessed parts.

Further, when the holder parts 22 and 22 and the first die part 20 are lowered, in the tailored blank plate 12, protruding parts 220*a* and 220*b* are formed that intersect orthogonally to the connecting surface 12*c* under the pressing operation of the punch protruding parts 50*a* and 50*b* of the first punch part 18 and the punch recessed parts 72*a* and 72*b* of the first die part 20 (see FIG. 6). In this case, the punch protruding parts 50*a* and 50*b* of the first punch part 18 and the punch recessed parts 72*a* and 72*b* of the first die part 20 respectively have relations of males and females so that the stepped part 12*b* of the tailored blank plate 12 may be firmly held. Thus, a displacement herein is prevented to expand and extend the tailored blank plate 12 along a part where the tailored blank plate is sandwiched between the first punch part and the first die part. Accordingly, the deformation of the tailored blank plate between the punch protruding parts 50*a* and 50*b* can be reduced as much as possible. Further, since the pressing part 70 of the first die part 20 carries out a pressing operation, the occurrence of a deformation due to the stepped part can be suppressed irrespective of the presence of the stepped part 12*b* of the tailored blank plate 12.

A re-striking process will be described that re-strikes, by further using the re-strike device 100, the tailored blank plate 12 draw-formed by using the press device 10 as described above.

Figure 2:
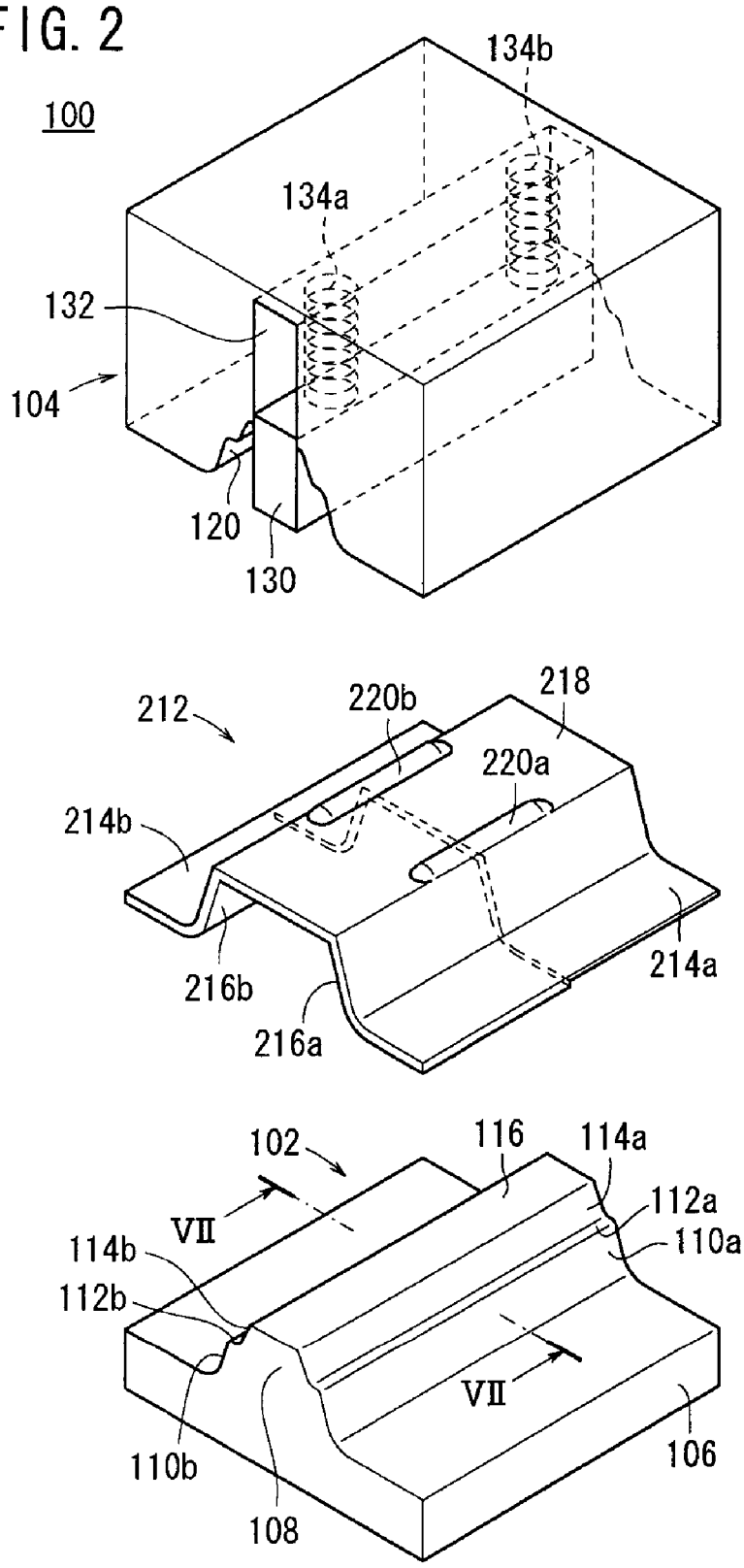
FIG. 2 is an exploded perspective view showing a re-strike device.

Here, the tailored blank plate 12 formed by the press device 10 is shown in FIG. 2. The tailored blank plate 12 that is processed by the press device is designated by reference numeral 212 in place of 12.

The tailored blank plate 212 has, at both end parts thereof, side parts 214*a* and 214*b* extending in the horizontal direction in the drawing and tapered surfaces 216*a* and 216*b* inclined at prescribed angles and standing inward from the side parts 214*a* and 214*b*. The tapered surfaces 216*a* and 216*b* are connected to a flat surface 218 at their terminating end parts. At both sides of a central part of the flat surface 218, the protruding parts 220*a* and 220*b* are provided that are formed by the punch protruding parts 50*a* and 50*b* of the first punch part 18 and the punch recessed parts 72*a* and 72*b* of the first die part 20. It is to be understood that the stepped part 12*b* is bent and left in the lower surface of the tailored blank plate 212 as it is as shown in FIG. 2.

Figure 7:
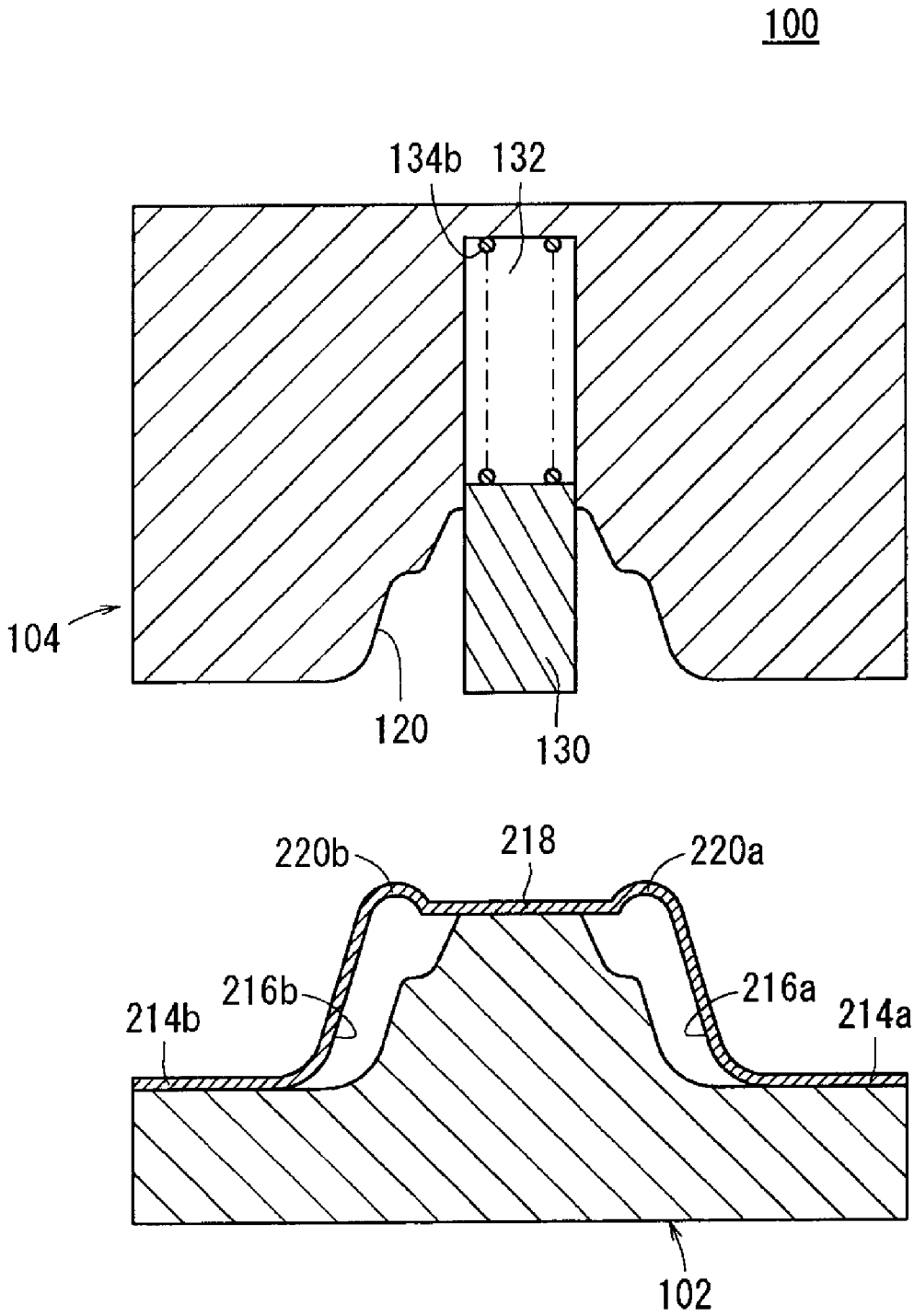
FIG. 7 is an entire sectional view taken along a line VII-VII in FIG. 2 showing a state immediately before the press-formed tailored blank plate is re-struck.

Thus, the tailored blank plate 212 that is press-formed as described above is mounted on the second punch part 102 (see FIG. 7). Namely, the side parts 214*a* and 214*b* are mounted on a horizontal surface forming the second base part 106. Since the second punch part 102 includes the tapered surfaces 110*a* and 110*b* and the stepped parts 112*a* and 112*b*, for the tapered surfaces 261*a* and 216*b* of the tailored blank plate 212, only the side parts 214*a* and 214*b* abutting on the second base part 106 and the flat surface 218 in contact with the flat surface 116 come into contact with the second punch part 102.

Figure 8:
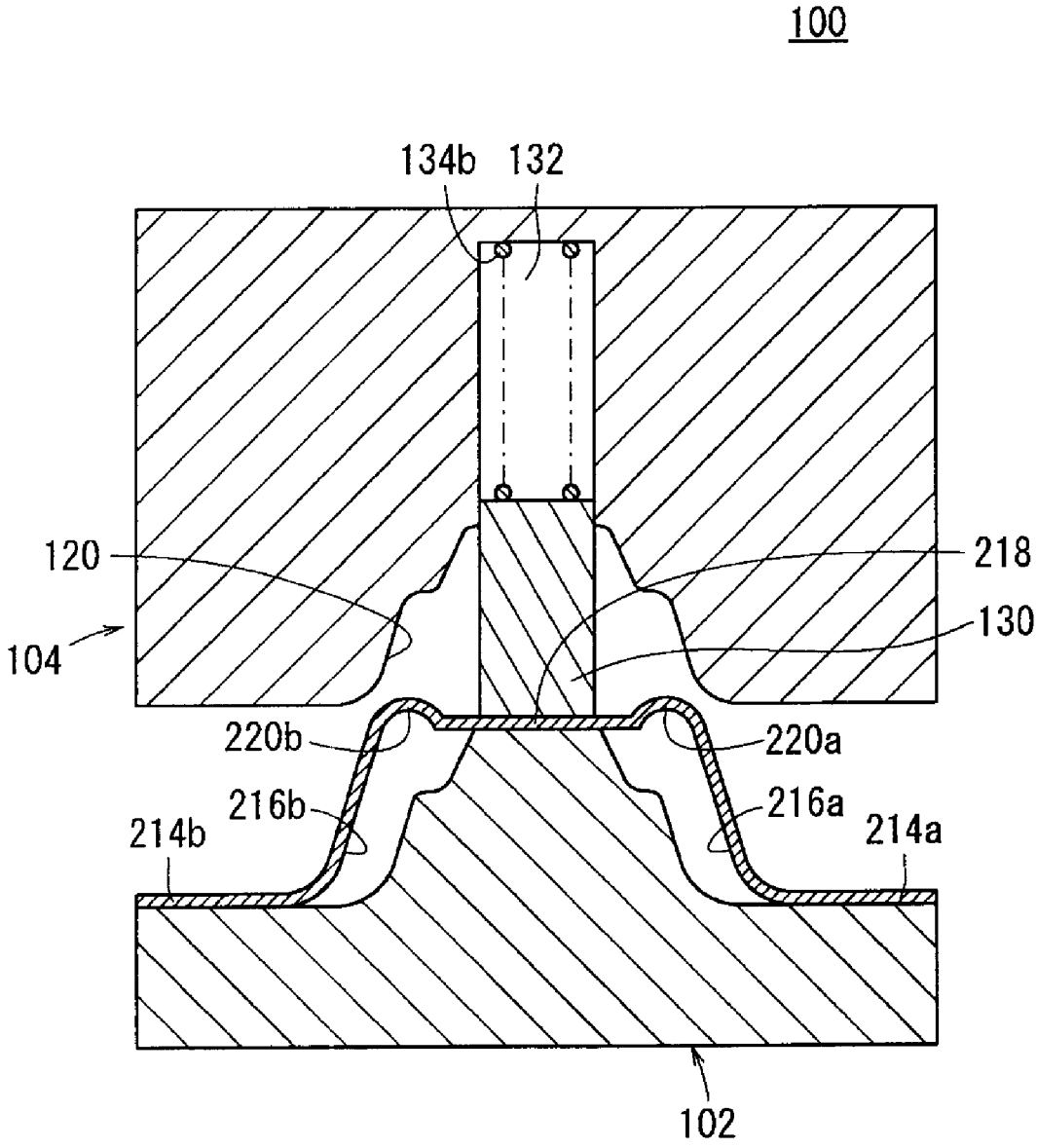
FIG. 8 is an entire sectional view taken along the line VII-VII in FIG. 2 showing a state that the press-formed tailored blank plate is pressed by a pad to re-strike the tailored blank plate.

Under this state, the second die part 104 forming the re-strike device 100 waits at the top part of the second base part 106. Accordingly, an entire part of the pad 130 substantially protrude to the recessed part 120 side from the chamber 132 by the resilient force of the coil springs 134*a* and 134*b* of the second die part 104. Thus, the second die part 104 starts to be lowered to come close to the second punch part 102. The pad 130 protruding downward from the recessed part 120 comes into contact with the flat surface 218 of the tailored blank plate 212 under pressure by the resilient force. This state is shown in FIG. 8. Namely, here, the flat surface 218 of the tailored blank plate 212 is sandwiched and positioned between the flat surface 116 of the second base part 106 and the lower end face of the pad 130 of the second die part 104.

Figure 9:
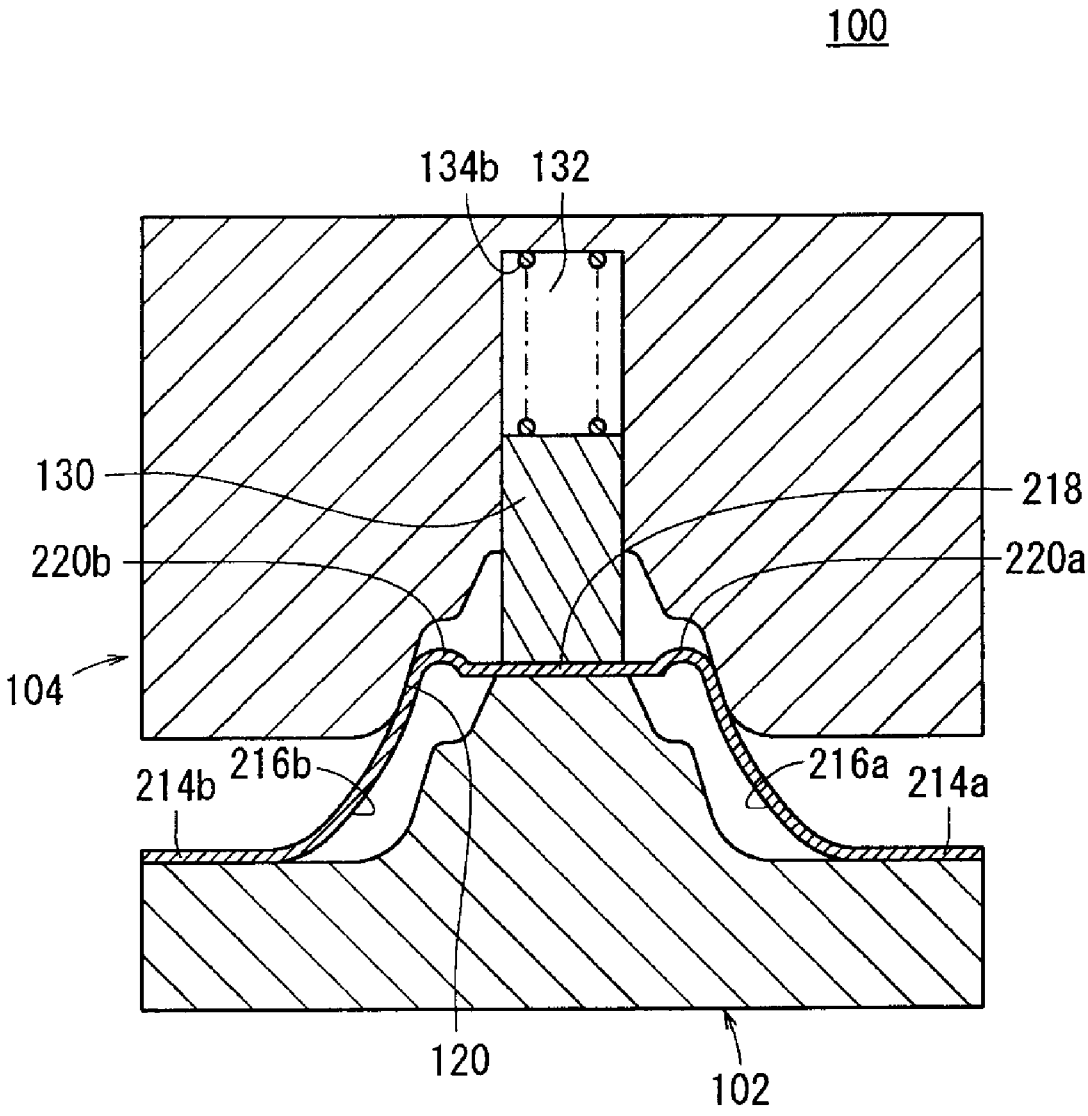
FIG. 9 is an entire sectional view taken along the line VII-VII in FIG. 2 showing a state that the tailored blank plate is in the midst of a re-striking process.

Then, when the second die part 104 starts to be further lowered, the tapered surfaces 216*a* and 216*b* of the tailored blank plate 212 abut on side surfaces forming the recessed part 120 of the second die part 104 so that the tapered surfaces 216*a* and 216*b* of the tailored blank plate 212 starts to be bent slightly inward. This state is shown in FIG. 9. At this time, the coil springs 134*a* and 134*b* of the second die part 104 are contracted to increase the resilient force and the coil springs are partly accommodated in the chamber 132.

Figure 10:
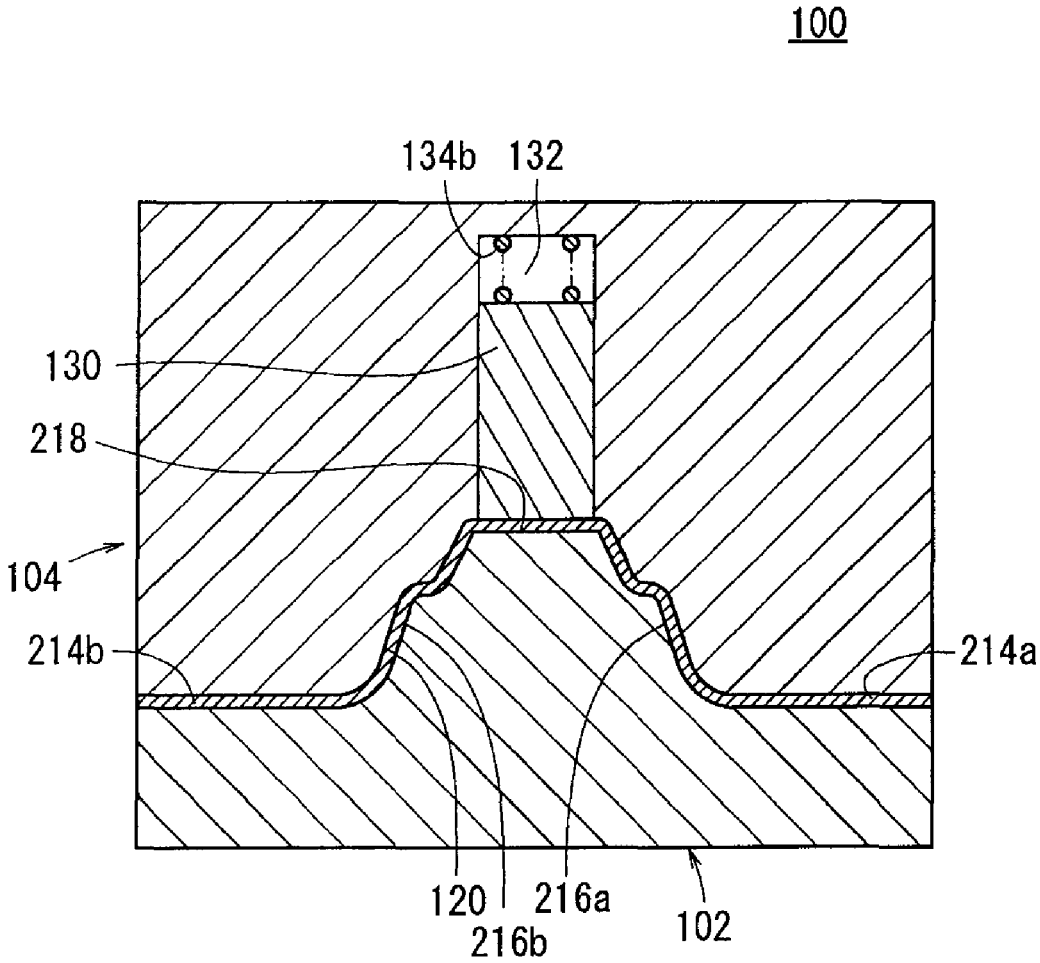
FIG. 10 is an entire sectional view taken along the line VII-VII in FIG. 2 showing a state that the tailored blank plate is re-struck.

Further, when the second die part 104 is further lowered, the entire part of the tailored blank plate 212 is strongly pressed by the second punch part 102 and the second die part 104 to obtain a desired final shape. The final shape of a tailored blank plate 300 is shown in a section view in FIG. 10. As easily understood from FIG. 10, an entire part of the pad 130 of the second die part 104 is accommodated in the chamber 132.

The second die part 104 may be lifted and separated from the tailored blank plate 212, and then, the tailored blank plate 300 processed to the final shape in such a way may be taken out from the second punch part 102.

Figure 11:
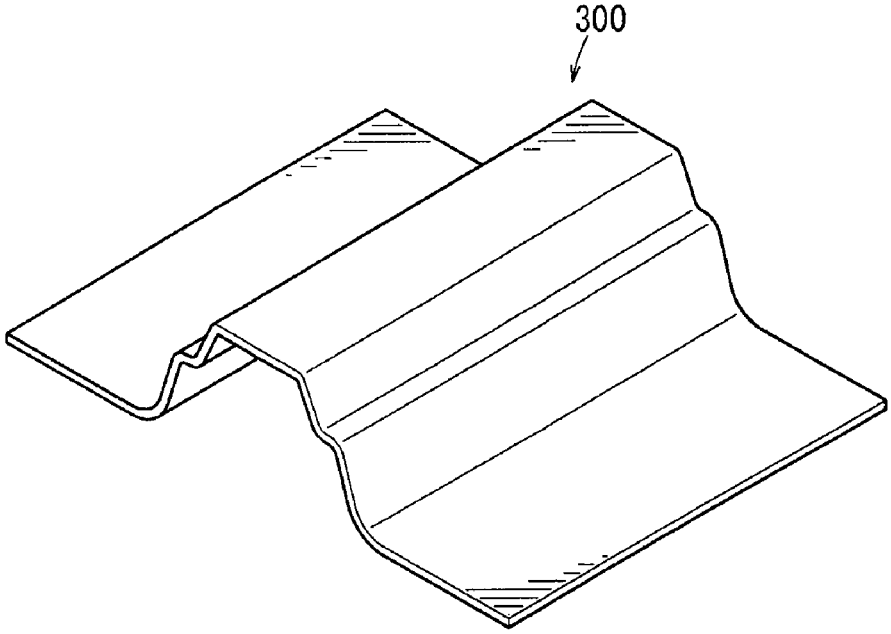
FIG. 11 is a perspective view of the re-struck tailored blank plate.

The tailored blank plate 30 is shown in a perspective view in FIG. 11. As easily understood from FIG. 11, the protruding parts 220*a* and 220*b* formed by the press device 10 are removed by the second punch part 102 and the second die part 104 forming the re-strike device 100 and a formed product is obtained that has desired tapered surfaces and stepped parts.

Figure 12:
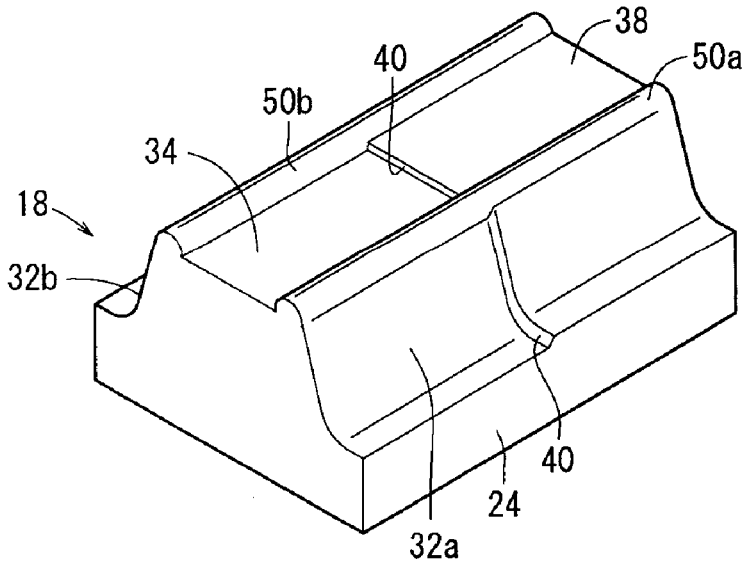
FIG. 12 is an entire perspective view showing a modified example of first punch protruding parts forming a press device.
Figure 13A:
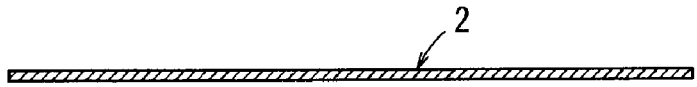
FIG. 13A is a sectional view of a workpiece before a process in a usual technique.
Figure 13B:
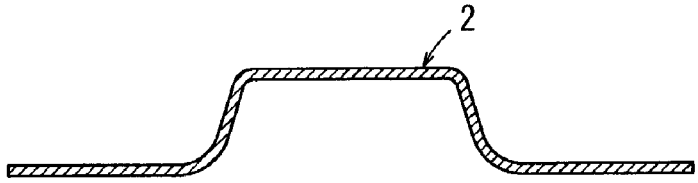
FIG. 13B is a sectional view of the workpiece after a drawing process in the usual technique.
Figure 13C:
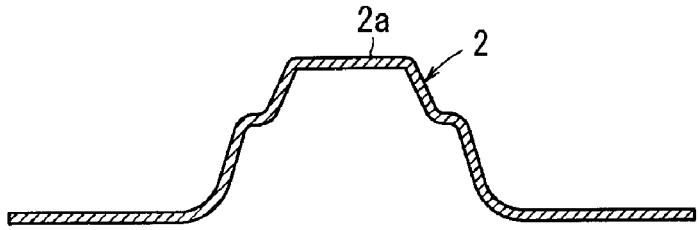
FIG. 13C is a sectional view of the workpiece after a re-striking process in the usual technique.
Figure 14:
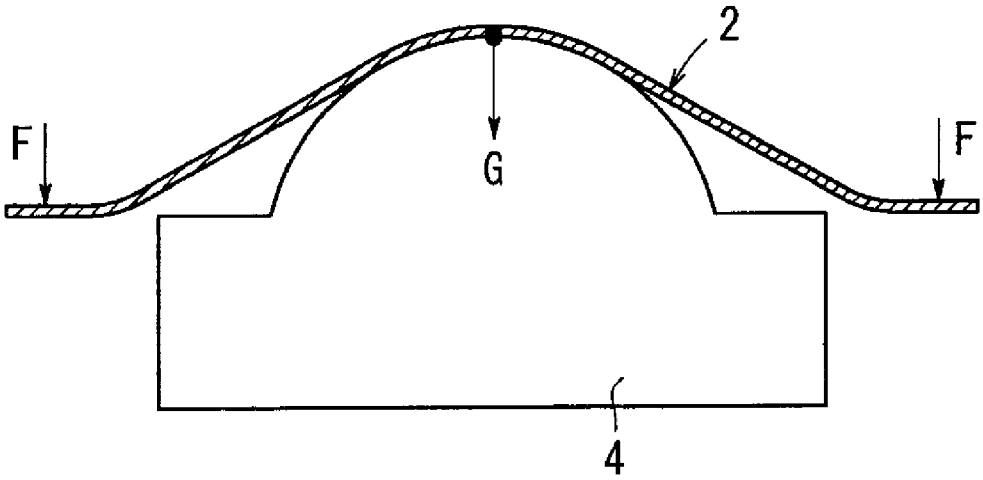
FIG. 14 is a partly omitted sectional view showing a contact state of a punch part and a tailored blank plate during the drawing process in the usual technique.

FIG. 12 shows a modified example of the press device 10 of the exemplary embodiment. The modified example is especially related to the first punch part 18. As easily understood from FIG. 12, in this modified example, punch protruding parts 50*a* and 50*b* of the first punch part 18 are provided over an entire length of a flat surface 34 for a thick plate and a flat surface 38 for a thin plate. Though not shown in the drawing, punch recessed parts 72*a* and 72*b* of a first die part 20 are also provided over the entire length of corner parts of a recessed part 62 correspondingly to the first punch part 18 according to this modified example.

According to the modified example, during the press-forming, the generation of corrugations or folds can be avoided in the tailored blank plate 212, that is, a workpiece, between the punch protruding parts to prevent the deformation of the tailored blank plate as in the press device 10 shown in FIG. 1. In this modified example, as described above, since the punch protruding parts 50*a* and 50*b* are formed to be long, a cost for forming the punch protruding parts 50*a* and 50*b* and the punch recessed parts 72*a* and 72*b* is more effectively reduced.

Although the method and the apparatus for processing the tailored blank plate according to the invention are described in connection with the specific exemplary embodiment and the modified example thereof, the present invention is not limited to the above-described exemplary embodiment and the modified example. It will be obvious to those skilled in the art that various changes and modifications may be made therein without departing from the present invention. It is aimed, therefore, to cover in the appended claims all such changes and modifications failing within the true spirit and scope of the present invention.

DESCRIPTION OF REFERENCE NUMERALS AND SIGNS

10 . . . press device 12 . . . tailored blank plate 12*a* . . . flat surface 12*b* . . . stepped part 12*c* . . . connecting surface 18 . . . first punch part 20 . . . first die part 22 . . . holder part 26 . . . punch main body 50*a*, 50*b* . . . punch protruding part 72*a*, 72*b* . . . punch recessed part

What is claimed is:

1. A method of forming a tailored blank plate, the tailored blank plate including a thin plate and a thick plate integrally connected to one another at a stepped part of the tailored blank plate, the forming method comprising:

providing a first punch part adapted to be at least partially received in a first die part, the first punch part including a pair of first punch protruding parts that protrude from a top surface of the first punch part toward the first die part and extend generally parallel to one another along the top surface;

positioning the tailored blank plate on the first punch part so that the stepped part of the tailored blank plate extends from one of the first punch protruding parts to the other of the punch protruding parts of the first punch part;

pressing a plate part of the tailored blank plate including a connecting surface of the thin plate and the thick plate, by making the first die part contact the positioned tailored blank plate, displacing the first die part with respect to the first punch protruding parts, and pressing a pressing part of the first die part to the plate part;

press-forming the tailored blank plate by moving the first punch part and the first die part to relatively come close to each other while fixing the stepped part of the tailored blank plate between the first punch protruding parts of the first punch part and a first punch recessed part of the first die part; and re-striking the press-formed tailored blank plate.

2. The method according to claim 1, wherein the tailored blank plate is mounted on the first punch protruding parts so that an extending direction of the stepped part of the tailored blank plate intersects an extending direction of the first punch protruding parts, in the step of positioning the tailored blank plate.

3. The method according to claim 1, wherein the step of re-striking comprises:

mounting the press-formed tailored blank plate on a second punch part for re-striking so that the tailored blank plate is bridged over at least one set of second punch protruding parts formed in the second punch part; and displacing a second die part for re-striking toward a part between the second punch protruding parts and pressing the part between the second punch protruding parts by a pad, so as to re-strike the tailored blank plate by the second punch part and the second die part.

4. A method of forming a tailored blank plate having a stepped part in which a thin plate is integrally connected to a thick plate, the forming method comprising:

positioning the tailored blank plate by mounting a side of the stepped part of the tailored blank plate on a first punch protruding part swollen on a first punch part;

pressing a plate part of the tailored blank plate including a connecting surface of the thin plate and the thick plate, by making a first die part in contact with the positioned tailored blank plate, displacing the first die part with respect to the first punch protruding part, and pressing a pressing part of the first die part to the plate part;

press-forming the tailored blank plate by moving first punch part and the first die part to relatively come close to each other while fixing the stepped part of the tailored blank plate between the first punch protruding part of the first punch part and a first punch recessed part of the first die part; and re-striking the press-formed tailored blank plate, wherein the step of re-striking comprises:

mounting the press-formed tailored blank plate on a second punch part for re-striking so that the tailored blank plate is bridged over at least one set of second punch protruding parts formed in the second punch part; and displacing a second die part for re-striking toward a part between the second punch protruding parts and pressing the part between the second punch protruding parts by a pad, so as to re-strike the tailored blank plate by the second punch part and the second die part.

5. The method according to claim 4, wherein the tailored blank plate is mounted on the first punch protruding part so that an extending direction of the stepped part of the tailored blank plate intersects an extending direction of the first punch protruding part, in the step of positioning the tailored blank plate.

* * * * *